US012534981B2

(12) United States Patent
Bestman et al.

(10) Patent No.: US 12,534,981 B2
(45) Date of Patent: Jan. 27, 2026

(54) DETECTING INTERFERENCE BETWEEN HYDROCARBON WELLS

(71) Applicant: Saudi Arabian Oil Company, Dhahran (SA)

(72) Inventors: Somiari Bestman, Dhahran (SA); Rasheed M. Almahdi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 529 days.

(21) Appl. No.: 18/079,679

(22) Filed: Dec. 12, 2022

(65) Prior Publication Data

US 2024/0191604 A1 Jun. 13, 2024

(51) Int. Cl.
*E21B 43/00* (2006.01)
*E21B 21/08* (2006.01)
(Continued)

(52) U.S. Cl.
CPC ..... *E21B 43/00* (2013.01); *E21B 21/08* (2013.01); *E21B 41/00* (2013.01); *E21B 43/14* (2013.01);
(Continued)

(58) Field of Classification Search
CPC ..... E21B 43/00; E21B 2200/20; E21B 41/00; E21B 49/00; E21B 44/00; E21B 43/14; E21B 49/003; E21B 21/08
See application file for complete search history.

(56) References Cited

U.S. PATENT DOCUMENTS 6,585,044 B2 7/2003 Rester et al.
RE42,245 E 3/2011 Thomas et al.
(Continued)

FOREIGN PATENT DOCUMENTS

WO WO 2020150540 A1 7/2020
WO WO 2022159567 7/2022
WO WO 2022204723 9/2022

OTHER PUBLICATIONS

Sui et al. (Production Splitting Method for Commingled Production Reservoir Based on Automatic History Matching of Single Well. Lithosphere 2022; Jan. 12, 2022; 2021 (Special 1): 9225890. doi: https://doi.org/10.2113/2022/9225890) (Year: 2022).*
(Continued)

*Primary Examiner* — Lisa M Caputo
*Assistant Examiner* — Christian T Bryant
(74) *Attorney, Agent, or Firm* — Fish & Richardson P.C.

(57) ABSTRACT

Disclosed are methods, systems, and computer-readable medium to perform operations including: obtaining production data about the well; generating a simulated average reservoir pressure at the subsurface region that includes the well; computing a difference between an average reservoir pressure obtained from the production data and the simulated average reservoir pressure; determining, based on the computed difference, a performance deviation with reference to a particular area of the subsurface region that includes the well; comparing the performance deviation to a predetermined threshold value that represents an acceptable tolerance for variance in performance of the well; and triggering, when the performance deviation exceeds the predetermined threshold value, a particular type of automated response comprising an action that addresses the variance in performance of the well.

20 Claims, 6 Drawing Sheets

(51) Int. Cl.

| | |
|---|---|
| ***E21B 41/00*** | (2006.01) |
| ***E21B 43/14*** | (2006.01) |
| ***E21B 44/00*** | (2006.01) |
| ***E21B 49/00*** | (2006.01) |

(52) U.S. Cl.
CPC ..... *E21B 44/00* (2013.01); *E21B 49/00* (2013.01); *E21B 49/003* (2013.01); *E21B 2200/20* (2020.05)

(56) References Cited

U.S. PATENT DOCUMENTS

| | | | |
|---|---|---|---|
| 8,195,401 | B2 | 6/2012 | Ella et al. |
| 8,653,979 | B2 | 2/2014 | Obenchain |
| 8,670,966 | B2 | 3/2014 | Rashid et al. |
| 8,676,721 | B2 | 3/2014 | Piovesan et al. |
| 9,063,250 | B2 | 6/2015 | Pop |
| 9,187,984 | B2 | 11/2015 | Usadi et al. |
| 9,200,511 | B2 | 12/2015 | Hon et al. |
| 9,567,843 | B2 | 2/2017 | Saeed et al. |
| 9,714,860 | B2 | 7/2017 | Obenchain |
| 9,946,974 | B2 | 4/2018 | Burch et al. |
| 10,198,535 | B2 | 2/2019 | Usadi et al. |
| 10,359,542 | B2 | 7/2019 | Kayode et al. |
| 10,487,649 | B2 | 11/2019 | Tilke et al. |
| 10,584,577 | B2 | 3/2020 | Tiss et al. |
| 10,689,972 | B1 | 6/2020 | Zhao et al. |
| 10,746,015 | B2 | 8/2020 | Munda et al. |
| 10,815,761 | B2 | 10/2020 | Arthur et al. |
| 11,008,837 | B2 | 5/2021 | Kim et al. |
| 11,308,409 | B1 | 4/2022 | Ortiz |
| 11,555,943 | B2 | 1/2023 | Ayub |
| 12,085,687 | B2 | 9/2024 | Lin et al. |
| 2002/0099505 | A1 | 7/2002 | Thomas et al. |
| 2002/0138241 | A1 | 9/2002 | Storm, Jr. et al. |
| 2007/0016389 | A1 | 1/2007 | Ozgen |
| 2010/0161300 | A1 | 6/2010 | Yeten et al. |
| 2010/0250215 | A1 | 9/2010 | Kennon et al. |
| 2012/0039668 | A1 | 2/2012 | Park et al. |
| 2013/0124171 | A1 | 5/2013 | Schuette et al. |
| 2014/0026085 | A1 | 1/2014 | Amminudin et al. |
| 2018/0202264 | A1 | 7/2018 | Sarduy et al. |
| 2018/0240021 | A1 | 8/2018 | Al-Harbi et al. |
| 2019/0065640 | A1 | 2/2019 | Singh et al. |
| 2019/0169982 | A1 | 6/2019 | Hauge et al. |
| 2019/0251460 | A1 | 8/2019 | Lam |
| 2019/0284926 | A1* | 9/2019 | Tiss ..... E21B 43/00 |
| 2019/0302310 | A1 | 10/2019 | Fox et al. |
| 2020/0325766 | A1 | 10/2020 | Gupta et al. |
| 2020/0362674 | A1 | 11/2020 | Alanazi et al. |
| 2021/0003540 | A1 | 1/2021 | Rendl |
| 2021/0003727 | A1 | 1/2021 | Zhu et al. |
| 2021/0027144 | A1 | 1/2021 | Madasu et al. |
| 2021/0046265 | A1 | 2/2021 | Obenchain |
| 2021/0048547 | A1 | 2/2021 | Nie et al. |
| 2021/0079770 | A1 | 3/2021 | Watson |
| 2021/0109252 | A1 | 4/2021 | Li |
| 2021/0124087 | A1 | 4/2021 | Liu et al. |
| 2021/0165938 | A1 | 6/2021 | Bailey et al. |
| 2021/0181374 | A1 | 6/2021 | Sandnes |
| 2021/0190558 | A1 | 6/2021 | Donzier et al. |
| 2021/0224682 | A1 | 7/2021 | Al-Nasser et al. |
| 2021/0225070 | A1 | 7/2021 | Al-Nasser et al. |
| 2021/0246766 | A1 | 8/2021 | Wilson |
| 2021/0301659 | A1 | 9/2021 | Al Shahri et al. |
| 2021/0349226 | A1* | 11/2021 | Alwehaibi ..... G01V 1/282 |
| 2022/0261513 | A1 | 8/2022 | AlQahtani et al. |
| 2022/0290554 | A1 | 9/2022 | Al Saad et al. |
| 2022/0397698 | A1 | 12/2022 | Bestman et al. |
| 2022/0414299 | A1 | 12/2022 | Benzvi |
| 2023/0041525 | A1 | 2/2023 | Hong et al. |
| 2023/0153661 | A1 | 5/2023 | Elkhomri |
| 2023/0186218 | A1 | 6/2023 | Bestman et al. |
| 2024/0076953 | A1* | 3/2024 | Trifol ..... E21B 34/025 |
| 2024/0169273 | A1* | 5/2024 | Sridhar, Sr. ..... E21B 43/00 |
| 2024/0191616 | A1 | 6/2024 | Bestman et al. |

OTHER PUBLICATIONS

Kabir et al., "Estimating Drainage-Area Pressure with Flow-After-Flow Testing," Prepared for presentation at the SPE Annual Technical Conference and Exhibition, Oct. 2-Nov. 2, 2011, Denver, Colorado, 19 pages.

Ramgulam et al., "Utilization of Artificial Neural Networks in the Optimization of History Matching," Prepared for presentation at the 2007 SPE Latin American and Caribbean Petroleum Engineering Conference held in Buenos Aires, Argentina, Apr. 15-18, 2007, 15 pages.

International Search Report and Written Opinion in International Appln. No. PCT/US2023/083529, dated Apr. 5, 2024, 17 pages.

Buhulaigah et al., "Multilateral Wells Evaluation Utilizing Artificial Intelligence," presented at the SPE Middle East Oil & Gas Show and Conference, Manama, Bahrain, Mar. 2017, 12 pages.

SAIP Examination Report in Saudi Arabian Appln No. 122431214, dated Nov. 8, 2023, 20 pages, with English Translation summary.

Mohamed et al., "Analysis of Multi-Layered Commingled and Compartmentalized Gas Reservoirs," Journal of Petroleum Exploration and Production Technology, Mar. 2018, 14 pages.

International Search Report and Written Opinion in International Appln No. PCT/US2023/083519, dated Mar. 25, 2024, 19 pages.

Back-Pressure Data on Natural-Gas Wells and Their Application to Production Practices, E.L. Rawlins, Lord Baltimore Press, 1935, 210 pages.

Kamal, "Interference and Pulse Testing—A Review," SPE-10042-PA, Journal of Petroleum Technology, Dec. 1983, 14 pages.

Ibrahim, "Optimizing Reservoir Management in South-Eastern Bangladesh: Insights from Type Curve Analysis," Jan. 2021, 13 pages.

SAIP Exam in Saudi Arabian Appln No. 122431214, dated Jul. 28, 2024, 17 pages with English translation.

* cited by examiner

DETECTING INTERFERENCE BETWEEN HYDROCARBON WELLS

TECHNICAL FIELD

This specification relates to method and systems for detecting interference between hydrocarbon wells.

BACKGROUND

Reservoir and production models can be used to monitor and manage the production of hydrocarbons from a reservoir. These models can be generated based on data sources including seismic surveys, other exploration activities, and production data. In particular, reservoir models based on data about the subterranean regions can be used to support decision-making relating to field operations.

In reflection seismology, geologists and geophysicists perform seismic surveys to map and interpret sedimentary facies and other geologic features for applications such as identification of potential petroleum reservoirs. Seismic surveys are conducted by using a controlled seismic source (for example, a seismic vibrator or dynamite) to create a seismic wave. In land-based seismic surveys, the seismic source is typically located at ground surface. The seismic wave travels into the ground, is reflected by subsurface formations, and returns to the surface where it is recorded by sensors called geophones. Other approaches to gathering data about the subsurface, such as information relating to wells or well logging, can be used to complement the seismic data.

SUMMARY

Interwell interference is increasingly becoming a problem in subterranean formations in which hydrocarbon (e.g., gas) wells are being developed. Interwell interference refers to any interference that the development of one well can cause to one or more other neighboring wells. As an example, the fracturing of one well can interfere with neighboring wells, perhaps by fractures colliding with the neighboring wells. As another example, an interference may be the result of an intrusion of fluids from one well into neighboring wells.

This specification describes techniques for using results of processing production data measured at a surface of a subsurface region as an early warning system during surveillance operations involving gas wells and subsurface reservoirs. An example computing system determines interwell interference between gas producing wells and uses the interference as a surveillance tool for managing gas reservoir operations. In response to detecting an interference or a potential interference between hydrocarbon wells, the computing system can select an automated response, which can include an action that may be initiated to address or correct the interference. The response or action addresses flow conditions of the gas well and can include a warning, an alarm, intervention by an autonomous system, total shut-in of the well, or a combination of these.

One aspect of the subject matter described in this specification may be embodied in a method implemented using a system for managing operations involving a well in a subsurface region. The method includes obtaining production data about the well. The method also includes generating a simulated average reservoir pressure at the subsurface region that includes the well. The method also includes computing a difference between an average reservoir pressure obtained from the production data and the simulated average reservoir pressure. The method also includes determining, based on the computed difference, a performance deviation with reference to a particular area of the subsurface region that includes the well. The method also includes comparing the performance deviation to a predetermined threshold value that represents an acceptable tolerance for variance in performance of the well. The method also includes triggering, when the performance deviation exceeds the predetermined threshold value, a particular type of automated response may include an action that addresses the variance in performance of the well.

The previously described implementation is implementable using a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium. These and other embodiments may each optionally include one or more of the following features.

In some implementations, determining a performance deviation involves: determining a magnitude of the performance deviation; or determining a magnitude of the variance in performance of the well.

In some implementations, triggering a particular type of automated response involves: selecting a particular type of automated response based at least on the magnitude of the variance in performance of the well; and triggering an action of the selected particular type of automated response that reduces the magnitude of the variance in performance of the well.

In some implementations, triggering an action of the selected particular type of automated response involves: triggering an action that eliminates the variance in performance of the well and the performance deviation.

In some implementations, the particular type of automated response includes at least one of: an action that generates a warning notification; or an action that generates an alarm signal.

In some implementations, the well is a gas or hydrocarbon producing well; and the simulated average reservoir pressure is based on predictions about a plurality of values for flow rate, pressure, and temperature relating to the gas or hydrocarbon producing well.

In some implementations, the performance deviation includes flow conditions of the well that are outside the acceptable tolerance for variance in performance of the well.

In some implementations, the particular type of automated response includes at least one of: an action that causes, by an autonomous system, intervention at the particular area of the subsurface region that includes the well; or a total shut-in of the gas producing well.

In some implementations, the performance deviation involves an interference between the well and at least one other well in the subsurface region.

The subject matter described in this specification can be implemented to realize one or more of the following advantages.

The disclosed framework uses machine-learning techniques to determine and show preferred, actual average reservoir pressure values, at least by manipulating obtained production data from surface measurements to yield actionable intelligence. The actionable intelligence is used to implement rapid, automated responses that mitigate performance deviations and realize efficiencies field operations involving hydrocarbon wells. Unlike existing systems that require downhole data, the disclosed methods and systems function using only surface acquired data.

The details of one or more embodiments of these systems and methods are set forth in the accompanying drawings and the following description. Other features, objects, and advantages of these systems and methods will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
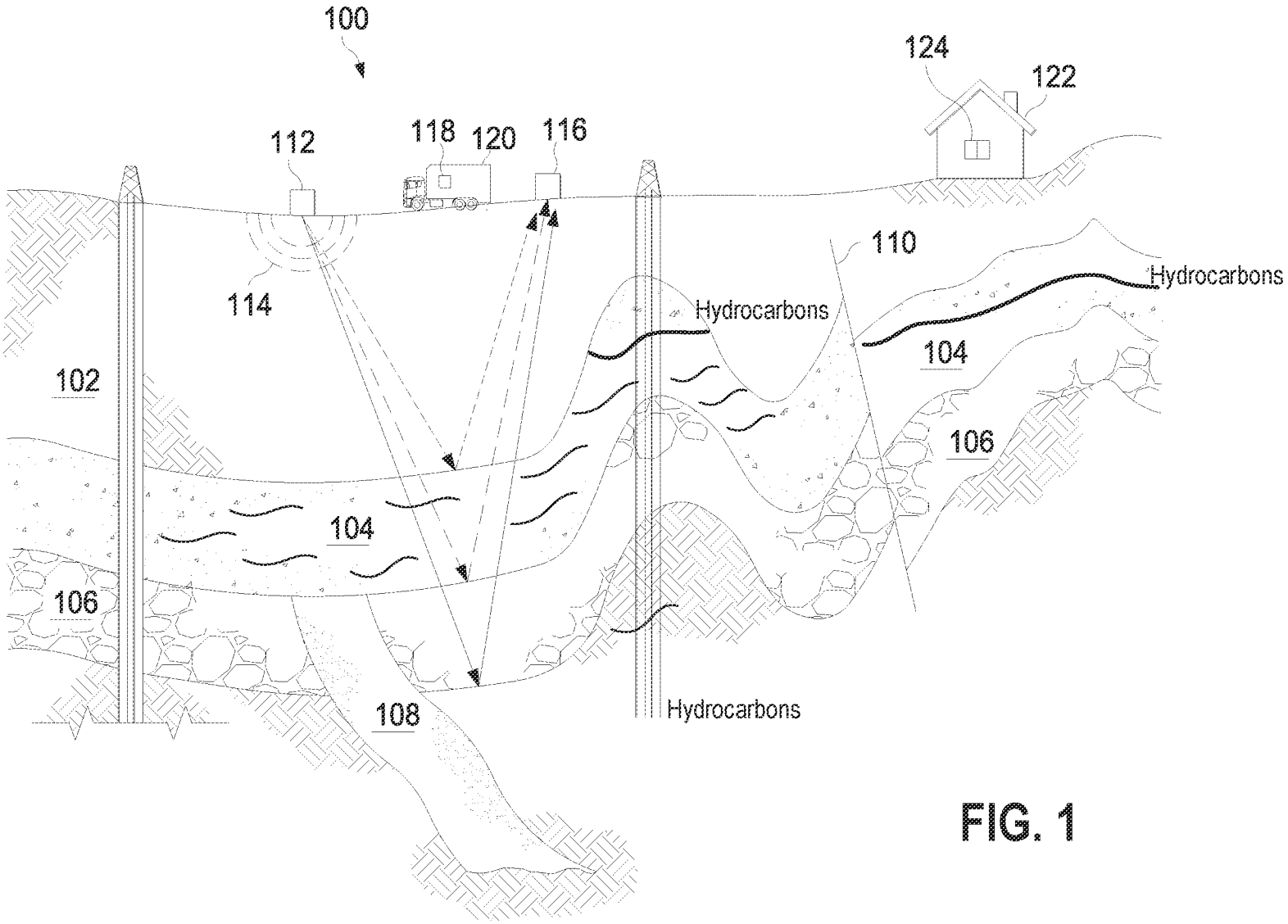
FIG. 1 is a schematic view of a seismic survey being performed to map subterranean features such as facies and faults, according to some implementations.

This disclosure describes an approach or framework for using interference detection between hydrocarbon (e.g., gas) wells as an operations and surveillance tool in reservoir management. As described in more detail below, a computing system implementing the framework can use production data measured at the surface for the interference detection. In particular, the computing system uses the production data from one or more wells in subsurface region to calculate average reservoir pressure values of a gas field, perhaps at specified intervals. The computing system uses a model of the one or more wells to simulate production of the wells, and to calculate simulated average reservoir pressure values of the gas field based on the simulated production data. The computing system uses the calculated average reservoir pressure values and the simulated average reservoir pressure values to predict or detect interference between two or more wells in the gas field.

As also described in more detail below, the computing system can use the methods described in U.S. Pat. No. 10,584,577 to calculate the average reservoir pressure values of the gas field from the production data. U.S. Pat. No. 10,584,577, entitled "In-situ reservoir depletion management based on surface characteristics of production," is incorporated herein by reference. And to simulate production of the target well, the computing system can use the methods described in U.S. patent application Ser. No. 17/347,251. U.S. patent application Ser. No. 17/347,251, entitled "Flow-After-Flow Tests in Hydrocarbon Wells," is incorporated herein by reference. Further, to compare the calculated average reservoir pressure values and the simulated average reservoir pressure values of the gas field, the computing system can use the methods described in U.S. patent application Ser. No. 17/549,606. U.S. patent application Ser. No. 17/549,606, entitled "Early Warning Detection of Performance Deviation in Well and Reservoir Surveillance Operation," is incorporated herein by reference.

U.S. Pat. No. 10,584,577 uses flowing wellhead pressure as various rates and compares how these flowing wellhead pressures change over time with each time step having an associated cumulative production. As such, a change in flowing wellhead pressure, $\Delta P$, can be attributed to a produced volume, V, over a time frame from t1 to t2. Time frame t1 may be defined as time step with known average reservoir pressure P1 (i.e., initial conditions with initial reservoir pressure). Therefore, at time t2 after producing volume V2 of gas and observing a change of flowing wellhead pressure of $\Delta P2$ then the new average reservoir pressure is $P1-\Delta P2$. As such, an identified change in flowing well head pressure is expected to also occur in the average reservoir pressure.

In response to detecting an interference or a potential interference between hydrocarbon wells, the computing system can select an autonomous response, which can include an action that may be initiated to address or correct the interference (or mitigate a potential interference). The autonomous response may be selected from a set of responses. In general, the autonomous response is uniquely operable to adjust or affect flow conditions of the hydrocarbon (e.g., gas) well and can be configured to cause a total shut-in of the well. For example, depending on the extent of the interference between the wells, the system can select from actions that include an automatic warning, an automatic alarm, intervention by an autonomous system, automatic total shut-in of the well, or a combination of these. This approach is described with reference to gas wells but can be applied to other types of production wells (e.g., oil wells).

FIG. 1 is a schematic view of activities being performed to map subterranean features such as facies and faults in a subterranean formation 100, according to some implementations.

FIG. 1 shows an example of acquiring seismic data using an active source 112. This seismic survey can be performed to obtain seismic data (such as acoustic data) used to generate a depth map in the subterranean formation 100. The subterranean formation 100 includes a layer of impermeable cap rock 102 at the surface. Facies underlying the impermeable cap rocks 102 include a sandstone layer 104, a limestone layer 106, and a sand layer 108. A fault line 110 extends across the sandstone layer 104 and the limestone layer 106.

Oil and gas tend to rise through permeable reservoir rock until further upward migration is blocked, for example, by the layer of impermeable cap rock 102. Seismic surveys attempt to identify locations where interaction between layers of the subterranean formation 100 are likely to trap oil and gas by limiting this upward migration. For example, FIG. 1 shows an anticline trap, where the layer of impermeable cap rock 102 has an upward convex configuration, and a fault trap, where the fault line 110 might allow oil and gas to flow in with clay material between the walls traps the petroleum. Other traps include salt domes and stratigraphic traps.

In some contexts, such as shown in FIG. 1, an active seismic source 112 (for example, a seismic vibrator or an explosion) generates seismic waves 114 that propagate in the earth. Although illustrated as a single component in FIG. 1, the source or sources 112 are typically a line or an array of sources 112. The generated seismic waves include seismic body waves 114 that travel into the ground and seismic surface waves that travel along the ground surface and diminish as they get further from the surface.

The seismic waves 114 are received by a sensor or sensors 116. Although illustrated as a single component in FIG. 1, the sensor or sensors 116 generally include one to several three-component sensors that are positioned near an example wellhead. The sensors 116 can be geophone-receivers that produce electrical output signals transmitted as input data, for example, to a computer 118 on a control truck 120. Based on the input data, the computer 118 may generate data outputs, for example, a seismic two-way response time plot or data production data associated wellsite operations. In some cases, the control truck 120 is an extension of a production system that is used to monitor and manage the production of hydrocarbons from a reservoir.

A control center 122 can be operatively coupled to the control truck 120 and other data acquisition and wellsite systems. The control center 122 may have computer facilities for receiving, storing, processing, and analyzing data from the control truck 120 and other data acquisition and wellsite systems that provide additional information about the subterranean formation. For example, the control center 122 can receive data from a computer associated with a well logging unit. For example, computer systems 124 in the control center 122 can be configured to analyze, model, control, optimize, or perform management tasks of field operations associated with development and production of resources such as oil and gas from the subterranean formation 100.

Alternatively, the computer systems 124 can be in a different location than the control center 122. Some computer systems are provided with functionality for manipulating and analyzing the data, such as performing data interpretation or borehole resistivity image log interpretation to identify geological surfaces in the subterranean formation or performing simulation, modeling, data integration, planning, and optimization of production operations of the wellsite systems.

In some embodiments, results generated by the computer systems 124 may be displayed for user viewing using local or remote monitors or other display units. One approach to analyzing data related to production operations is to associate a particular subset of the data with portions of a seismic cube representing the subterranean formation 100. The seismic cube can also be display results of the analysis of the data subset that is associated with the seismic survey. The results of the survey can be used to generate a geological model representing properties or characteristics of the subterranean formation 100.

The models and control systems can automatically acquire production data (e.g., gas and liquid production rates, flowing wellhead pressure [FWHP], flowing wellhead temperature, temperatures and pressures are measured upstream and downstream of the production choke). In some implementations, these models and systems can be configured to acquire measured production data in real-time, including surface measured production. For example, the production data can be acquired at a dynamic or user-defined rate, such as hourly, daily, or weekly. Comparing modeled and actual average reservoir pressure values can be used as an indication of interference between neighboring gas wells in a gas field. Early warning detection of interference between neighboring gas wells can be used in monitoring and managing wells and reservoirs (among other production operations).

Figure 2:
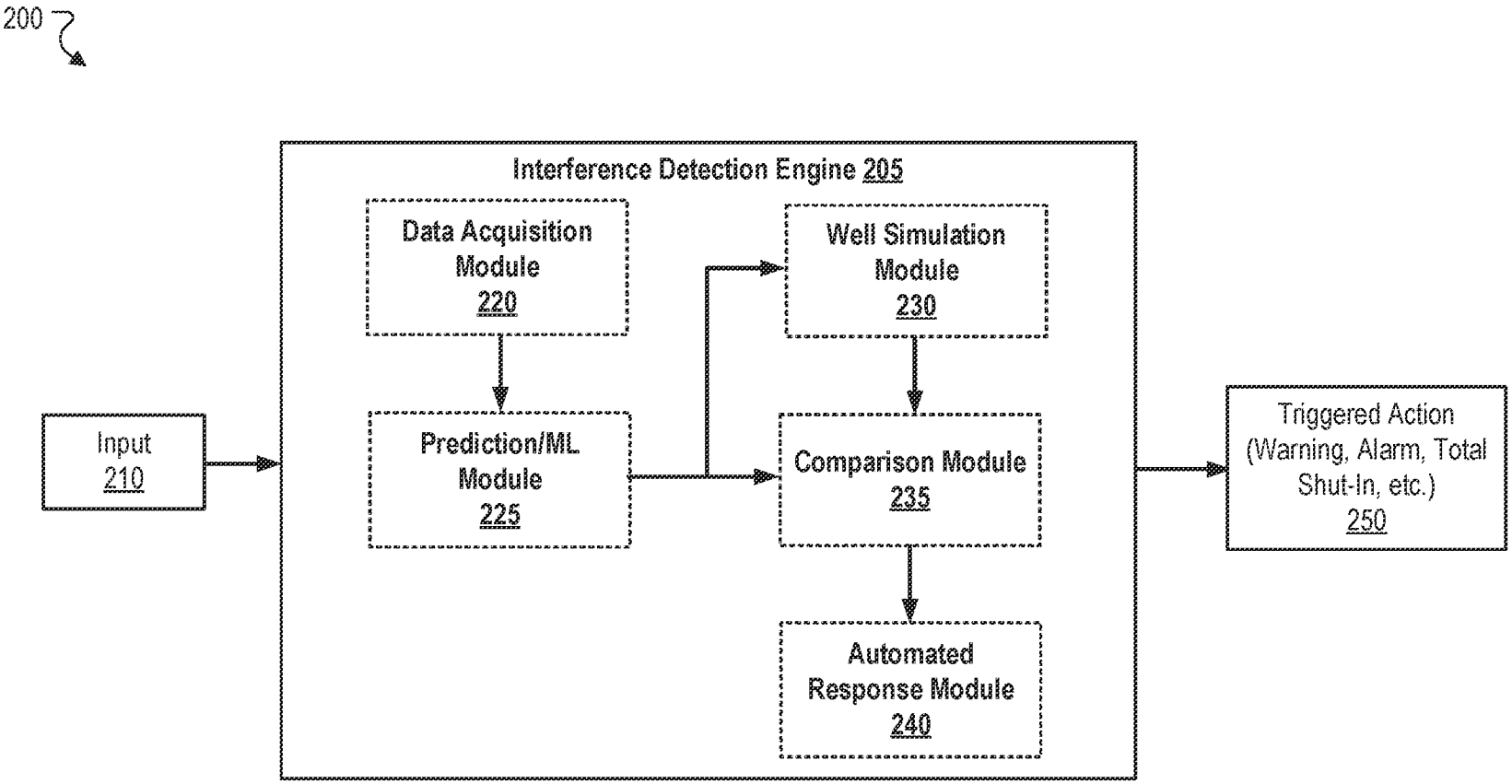
FIG. 2 illustrates an example computing system for implementing early warning detection of performance deviation in gas well and reservoir surveillance operations, according to some implementations.

FIG. 2 illustrates an example computing system 200 for implementing early warning detection of interference between neighboring gas wells in well and reservoir surveillance operations. Neighboring gas wells are wells that are located within a threshold distance of each other, perhaps in the same gas field. The system 200 includes an interference detection engine 205 ("detection engine 205") that processes sets of production input data to generate a triggered action 250, which represents a desired output response for managing operations of one or more wells.

Each of the system 200 and the detection engine 205 may be included in the computer system 124 described earlier with reference to FIG. 1. For example, each of the system 200 and the detection engine 205 can be included in the computer system 124 as a sub-system of hardware circuits, such as a special-purpose circuit, that includes one or more processor microchips. Although a single detection engine 205 is shown in the example of FIG. 2, in some cases the computer system 124 can include multiple detection engines 205 as well as multiple systems 200. Each detection engine 205 can include processors, for example, a central processing unit (CPU) and a graphics-processing unit (GPU), memory, and data storage devices. Each of the system 200 and the detection engine 205 can also be included in a computer system 600, which is described later with reference to FIG. 6.

In some implementations, the detection engine 205 is utilized as an automated application for well and reservoir surveillance. More specifically, the detection engine 205 can be used to provide an early warning and mitigation system that generates automated warnings to a user of interference between gas wells as well as automated response actions to eliminate or mitigate occurrence of the interference. In some cases, the system 200 actively performs at least one response function to address the interference. The system 200 may also provide various early warning indications requiring more investigation towards confirmation.

In some implementations, the detection engine 205 includes a data acquisition module 220, a prediction & machine-learning (ML) module 225 ("prediction module 225"), a well simulation module 230, a comparison module 235, and an automated response module 240. Modules of the detection engine 205 can be implemented in hardware, software, or both. In some implementations, the term "module" includes software applications/programs or a computer that executes one or more software programs (e.g., program code) that causes a processing unit(s) of the computer to execute one or more functions. The term "computer" is intended to include any data processing device, such as a desktop computer, a laptop computer, a mainframe computer, an electronic notebook device, a computing server, a smart handheld device, or other related device able to process data.

The data acquisition module 220 is operable to perform automatic acquisition of production data corresponding to input data 210. The input data 210 can be production data from one or more wells in a target reservoir or subsurface region. For example, the production/input data 210 includes gas and liquid production rates, flowing wellhead pressure (FWHP), and flowing wellhead temperature from one or more wells in the target reservoir. In some implementations, the data acquisition module 220 represents an application of system 200 that is configured to acquire measured production data in real-time, including surface measured production data. The data acquisition module 220 can acquire the production data at a dynamic or user-defined rate, such as hourly, daily, or weekly.

The prediction module 225 can be implemented in hardware, software, or both. In some implementations, the prediction module 225 is a computing device used to generate predictive models for modeling properties and characteristics of a subsurface region including a well or reservoir. For example, the predictive models can be used for modeling reservoir behavior in support of decision making relating to field operations for gas wells. The computing device may be an example machine-learning module included in the computer system 124 described earlier with reference to FIG. 1.

The computing device representing the prediction module 225 can be a special-purpose hardware integrated circuit of the computer system 124, and which includes one or more processor microchips. The computing device can also be included in a computer system 600, which is described later with reference to FIG. 6. The special-purpose circuitry can be used to implement machine-learning algorithms corresponding to learning or inference techniques that are implemented using, for example, neural networks or support vector machines. In general, the computing device can include processors, for example, a central processing unit (CPU) and a graphics-processing unit (GPU), memory, and data storage devices that collectively form one or more computing devices of computer systems 124.

The prediction module 225 applies machine-learning techniques on at least a portion of the production data obtained by the data acquisition module 220, for example, to identify abnormal production data behavior in response to processing the received production data. The production data operated on at prediction module 225 may be passed to the prediction module 225 from the data acquisition module 220, for example, following processing of the production data at the data acquisition module 220. In some implementations, the prediction module 225 processes the production data concurrent with one or more operations that are performed on the production data at the data acquisition module 220.

The prediction module 225 is configured to perform quality assurance/quality control (QA/QC) processes on sets of production data. For example, the prediction module 225 can include a first ML data model that is trained to apply one or more QA/QC techniques.

The first QA/QC ML data model is configured to perform one or more functions that preserve or enhance data integrity of a production data stream, including surface measured production data. In some implementations, the QA/QC model is operable to ensure rate, pressure and temperature values adhere to a particular expected trend. For example, if a particular rate increase is observed then the model is tuned to apply a corresponding decrease in pressure and vice versa. The QA/QC model checks to ensure that the rate and pressure relationship is acceptable. For example, if an abnormal behaviour is identified, then the QA/QC model generates a data integrity flag indicating the data corresponding to the rate and pressure relationship is unacceptable or not within an acceptable range. The QA/QC model is operable to ensure rate and pressure are synchronized. For example, the prediction module 225 is configured to provide this synchronization at least by ensuring both rate and pressure quantities must be measured at the same time.

The QA/QC model is operable to detect and delete "missing" data points in a set of production data. For example, the QA/QC model can identify and discard production datasets with "NA" or blanks for a given data field or parameter of the dataset. The QA/QC model is operable to ensure computations of average values use relevant data. For example, the prediction module 225 can use the QA/QC model to determine whether each computed average pressure is related to a single rate. More specifically, the QA/QC model can be used to enforce a requirement that each computed average pressure must be related to a particular single rate.

The QA/QC model is operable to consistently identify the appropriate initial pressures for a given operation. For example, the QA/QC model can provide consistency in its identification and use of the correct initial reservoir pressure at a first time step iteration of a given operation. The QA/QC model is operable to ensure a particular set of data is from a correct sampling point. For example, if detection engine 205 is to perform analysis on well-A, rather than well-B, the QA/QC model is operable to scan or analyze source information, such as an indicator embedded in the production data, to ensure that data on which analysis is to be performed is indeed from well-A. The prediction module 225 may perform additional operations to verify and confirm a sampling point of the data.

The QA/QC model is operable to identify and ignore data values that are flagged as outliers. For example, a data value or parameter may be flagged as an outlier if its value is outside of an acceptable range of values for that specific type of parameter or data value.

The first ML data model can be trained in response to processing a set of training data using an example ML algorithm. For example, the first ML data model can use at least a random forest algorithm or other related, supervised ML algorithms to perform its QA/QC processes on actual production data. The training data can be a set of historic production data used to predict what is considered as "correct" or expected data behavior. During both a training phase and an implementation phase, the system 200 can modify its data models by adjusting the model parameters or re-tuning a set of weights of the ML model during a subsequent training or processing iteration of the data model.

The prediction module 225 applies at least the QA/QC techniques to identify and filter outliers, including items that constitute "bad data," from a streaming data set of production data received at the data acquisition module 220. In some implementations, the prediction module 225 is configured to generate one or more predicted values to augment existing pressure, temperature, or flow rate values of a production dataset. The predicted values can be used to replace missing or flawed data points. For example, the prediction module 225 can identify a value that is outside a particular range based on a parameter that indicates a specific type of the data value. In some implementations, the type of a data value is indicated via a bitmap that specifies the data value as a temperature value, pressure value, or flow value.

In some implementations, a well simulation module 230 is configured to generate a well model of one or more wells in the target reservoir. In an example, the well simulation module 230 generates a well model using a second ML data model. The second ML data model is trained using actual surface production data for a past period. The past period may be specified by a user, dynamically determined, or both. The training process of the second ML data model can use data vetted by the QA/QC process of prediction module 225. In some examples, the second ML model is trained on data from, for example, a past period of three months prior to a designed test date. The past period prior to the designed test data can vary and may be more than, or less than, 3 months. The training data includes values for flowing wellhead pressure, flowing wellhead temperature, and a produced gas rate. Some (or all) of the flowing wellhead pressures and flowing wellhead temperatures can be upstream and downstream of the production choke. In some examples, the training data is data that is identified, automatically (e.g., by the prediction module 225) or manually (e.g., by user), as data that is associated with a well that is not subject to interference.

In some implementations, the prediction module 225 calculates the average reservoir pressure based on the production data from one or more wells. In particular, the prediction module 225 uses flowing wellhead pressure at various rates and compares how these flowing wellhead pressures change over time with each time step having an associated cumulative production. As such, a change in flowing wellhead pressure, ΔP, can be attributed to a produced volume, V, over a time frame from t1 to t2. Time frame t1 may be defined as time step with known average reservoir pressure P1 (i.e., initial conditions with initial reservoir pressure). Therefore, at time t2 after producing volume V2 of gas and observing a change of flowing wellhead pressure of ΔP2 then the new average reservoir pressure is P1−ΔP2. As such, an identified change in flowing well head pressure is expected to also occur in the average reservoir pressure. Note that the production data can be from with multiple wells to capture statistical variations across field, but is also possible with one well.

In some implementations, the well simulation module 230 is used to simulate performance of one or more wells. In an example, the well simulation module 230 uses a well model to simulate a flow-after-flow test in the one or more wells. As described, the well simulation module 230 trains a machine learning model using historical well production data (for example, flow rates, flowing pressure, and flowing temperatures). The simulation system (or another system) uses the trained model to simulate a flow-after-flow test in the well (or a related well). In particular, the simulation system provides a particular flow rate of the hydrocarbon well as input to the trained model. The trained model simulates the flow-after-flow test for the hydrocarbon well at the particular flow rate and provides as an output flowing pressures and flowing temperatures in the hydrocarbon well. The results of the simulation of the flow-after-flow can be used to detect flow potential of hydrocarbons.

In some implementations, the well simulation module 230 calculates simulated average reservoir pressure values based on the simulation production values.

In some implementations, the comparison & deviation module 235 ("comparison module 235") is configured to compute a difference between measured conditions obtained from the production data and predicted conditions at a well, the subsurface region, or both. The comparison module 235 is configured to determine a performance deviation with reference to the well or with reference to a particular area of the subsurface region that includes the well, a reservoir, or both. In some examples, the detection engine 205 determines that a performance deviation exists in response to identifying or determining variations of average reservoir pressures.

In some implementations, the detection engine 205 makes these determinations by analyzing outputs of comparative operations performed by the comparison module 235 against actual and modeled (or predicted) production data streams. As an example, a portion of the actual production data stream can be real-time observation of flowing wellhead pressure at a given gas flow rate, whereas the modeled production data stream is a set of predicted nominal values for flowing wellhead pressure at the given gas flow rate. As another example, the comparison module 235 can compare actual average reservoir pressures to simulated average reservoir pressures.

In some implementations, the modeled production data stream is iteratively determined (e.g., daily or hourly) to provide a reference point against which new sets of production data are compared. The reference point provides a basis for detecting deviations or variances in performance of a well. The reference point can be dynamically updated to more accurately determine and assess deviations or variances in performance of a hydrocarbon well.

The comparison module 235 is also configured to compare any detected performance deviations to a predetermined threshold value that represents an acceptable tolerance for variance in performance of the well. For example, the detection engine 205, using the comparison module 235, can make determinations about performance of a hydrocarbon well by analyzing actual and simulated average reservoir pressures associated with the hydrocarbon well. Based on this compare operation, the comparison module 235 can generate and pass a control signal to the automated response module 240 to initiate selection of a particular type of automated response.

The control signal may indicate that the performance deviation exceeds the predetermined threshold value. When the performance deviation exceeds the predetermined threshold value, the automated response module 240 triggers a particular type of automated response including an action that addresses the variance in performance of the well. In some implementations, the automated response module 240 is configured to generate one or more commands for performing an action to address a particular performance deviation or variance. The commands can be control signals that cause one or more devices of system 200 to perform an action that eliminates, mitigates, or otherwise addresses a detected performance deviation.

Figure 3:
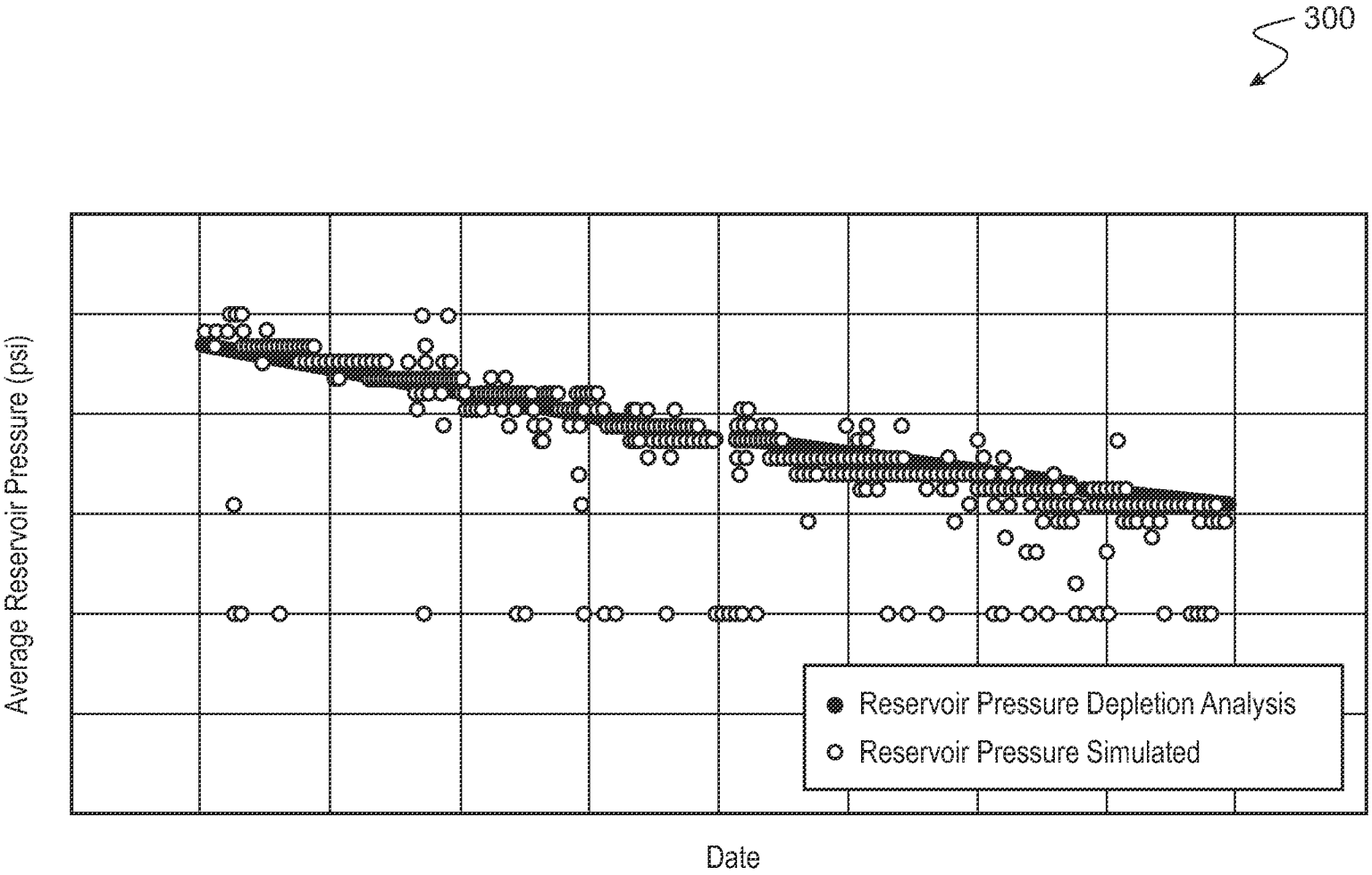
FIG. 3 illustrates example graphical data showing modeled and actual average reservoir pressures, according to some implementations.

FIG. 3 illustrates example graphical data 300 showing modeled and actual average reservoir pressures, according to some implementations. In this example, the deviation between the modeled and the actual average reservoir pressures does not exceed a predetermined threshold. Therefore, no interference is detected.

Figure 4:
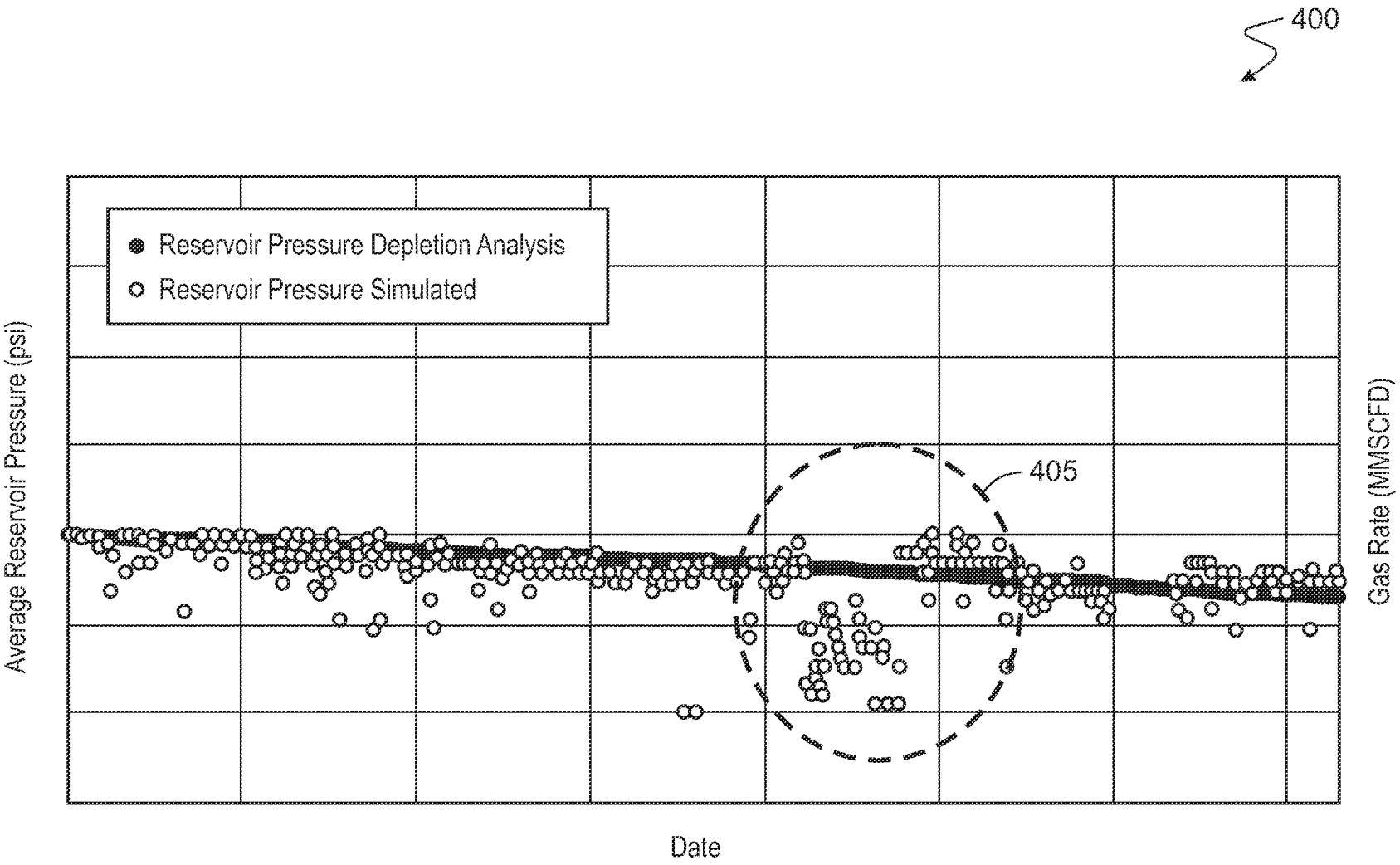
FIG. 4 illustrates another example graphical data showing modeled and actual average reservoir pressures, according to some implementations.

FIG. 4 illustrates another example graphical data 400 showing modeled and actual average reservoir pressures, according to some implementations. In this example, the graphical data shows a performance deviation with reference to a group of graphical data points indicated by circle 405. Accordingly, in this example, interference is detected.

Figure 5:
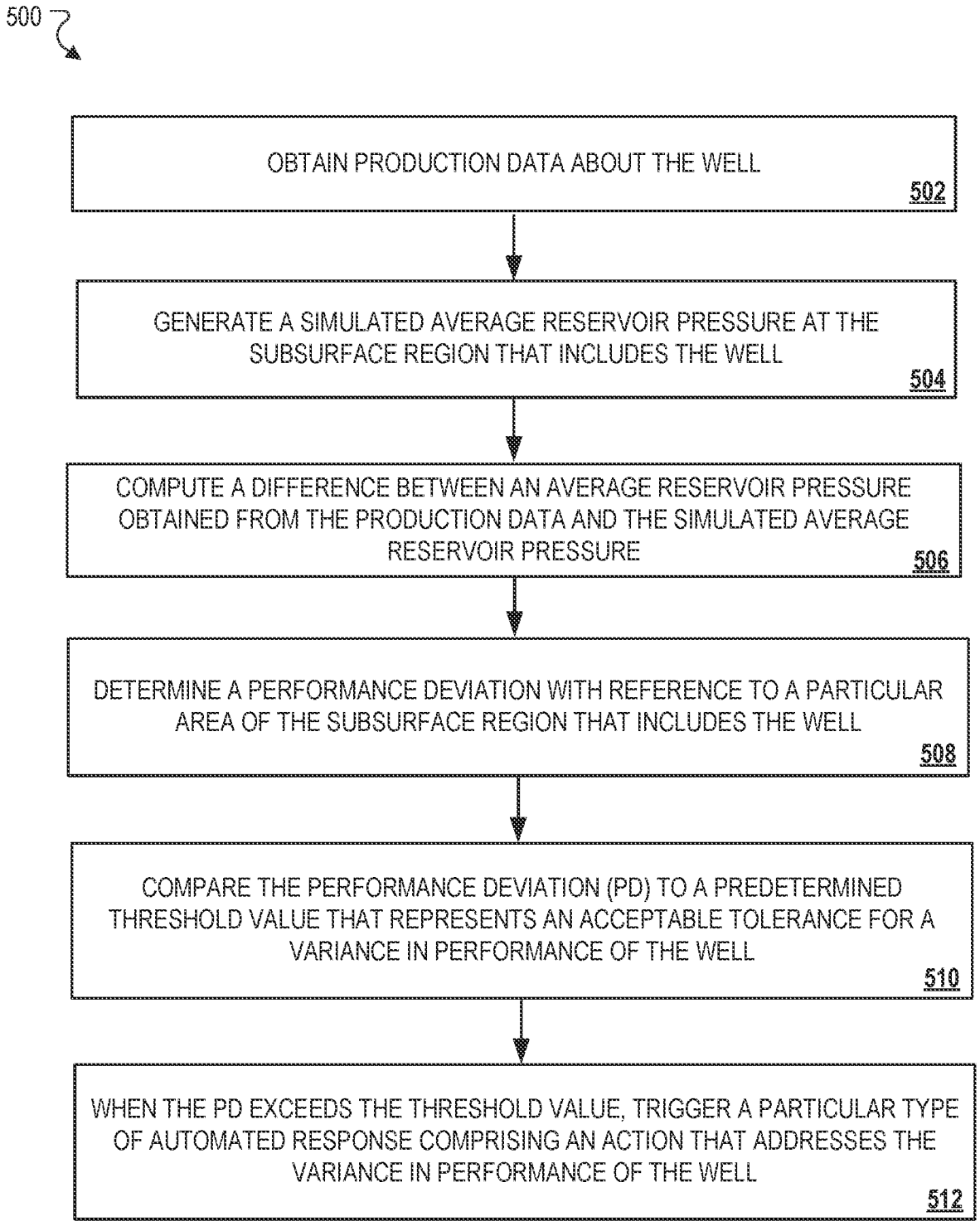
FIG. 5 is an example process for performing early warning detection of performance deviations, according to some implementations.

FIG. 5 is an example process 500 for performing early warning detection of performance deviations, according to some implementations. More specifically, process 500 is used to implement early warning detection of performance deviations in gas well and reservoir surveillance operations.

For example, process 500 may be performed daily or iteratively as part of a check performed by an example user, such as a field engineer or team of field engineers. For example, the team can perform some (or all) of the steps of process 500 when the team checks production details for each well for several fields. In some cases, the automated way process 500 can be implemented streamlines the otherwise tedious and time-consuming task of checking and monitoring performance of large fields that contain multiple wells.

Process 500 can be implemented or executed using the computer systems 124 and the detection engine 205 of a system 200. Hence, descriptions of process 500 may reference the computing resources of computer systems 124 and the detection engine 205 described earlier in this document. In some implementations, the steps or actions included in process 500 are enabled by programmed firmware or software instructions, which are executable by one or more processors of the devices and resources described in this document.

Process 500 includes the system 200 obtaining production data about the well (502). For example, the production data may be obtained prior to when an engineer or team checks production details for each well for several fields. In some implementations, the data acquisition module 220 is operable to receive or obtain multiple sets of production data that includes data values for various types of flow conditions that may be observed at a subsurface region that includes a reservoir and one or more gas wells. The production data can be surface measured production data, such as flowing wellhead pressure, gas production rate, liquid production rate, flowing wellhead temperature, or a combination of these.

In some implementations, the data acquisition module 220 is configured to obtain a surface production data stream and transform the data to a bottomhole equivalent, e.g., a flowing bottom-hole pressure and flowing bottom-hole temperature. For example, the data acquisition module 220 can apply the transformation using a well performance modeling application. Additionally and/or alternatively, the data acquisition module 220 is configured to obtain a surface production data stream and calculate average reservoir pressures, e.g., at specified intervals.

The system 200 generates predictions about conditions at a subsurface region that includes the well. For example, the system can generate a simulated average reservoir pressure at the subsurface region that includes the well (504). Prior to generating predictions, the prediction module 225 can perform its QA/QC processes on the production data to cause outliers and "bad data" to be filtered or deleted from the streaming data set. For example, the prediction module 225 can apply an example filter that removes data values that are identified as abnormal data points of a production set. In some implementations, the system 200 generates a filtered set of production data in response to passing the production data through an example QA/QC process such that one or more QA/QC techniques are applied to the production data stream.

The prediction module 225 includes a "predict average reservoir pressure" application that is configured to generate an average pressure for each time step of an observation window of the gas well. The prediction module 225 uses this application to generate a set of average pressures for each time step of a first observation window. In some implementations, the well simulation module 230 generates a parallel data stream to facilitate the checks performed by the engineer, which can include the engineer's review of the actual production data of a well for a new day.

The parallel data stream generated by the well simulation module 230 provides a modeled performance output indicating expected well performance. This parallel production data stream (or modeled performance output) represents predicted conditions of the well against which the measured conditions of the obtained production data can be compared. The parallel production data stream can include nominal values for average reservoir pressure. One or more of the nominal data points can correspond to a reference point(s) described earlier and which provide a basis for detecting deviations or variances in performance of the well.

The well simulation module 230 can generate modelled production data while concurrently mitigating against depletion effects, where depletion refers to a loss in average reservoir pressure over production time. This particular type of loss can translate to a loss of flowing wellhead pressure with associated thermal effects that can degrade analytical outputs for accurately assessing gas well performance.

The system 200 computes a difference between an average reservoir pressure obtained from the production data and the simulated average reservoir pressure (506). To obtain at least a portion of its predicted conditions, the system 200 uses the "virtual deliverability test" application to generate information describing a rate versus surface pressure relationships. For example, the relationship serves as a surface inflow performance relationship (IPR) showing how pressure and rate are related at a region that includes the gas well. The surface IPR may be transformed to a bottom-hole equivalent and used to develop a wellbore flow model. In some implementations, developing the wellbore flow model includes applying the transformation by using one or more exiting, analytical modeling applications.

To generate the predicted conditions, an ML data model of the well simulation module 230 applies an analytical framework that is derived from a particular ML algorithm. The well simulation module 230 develops the analytical framework in response to training the data model using the ML algorithm. The data model may be trained with one or more sets of production data as described earlier with reference to FIG. 2. As such, when a user submits a test design with several flow gas production rates, the ML data model can predict the expected associated flowing wellhead pressure and flowing wellhead temperature, upstream and downstream of a production choke. Further, based on the predicted data, the well simulation module 230 can calculate a simulated average reservoir pressure.

In some implementations, the rate measured at each time step of an observation window of the gas well will have associated measured average reservoir pressures as well as predicted average reservoir pressures based on the output of the virtual deliverability test application. As explained in detail at the following paragraphs, based on a difference between the measured and predicted average reservoir pressures for each rate at each time step an automated action will be selected and initiated by the system or taken by the application.

A performance deviation is determined with reference to a particular area of the subsurface region that includes the well (508). For example, the determined difference between the measure and predicted conditions corresponds to a performance deviation. A performance deviation can include flow conditions of the gas well that are outside the acceptable tolerance for variance in performance of the well. The performance deviation can also include the occurrence (or the potential occurrence) of interwell interference. In some implementations, determining a performance deviation includes determining a magnitude of the performance deviation or determining a magnitude of the variance in performance of the well. For example, a variance in performance of the well may rise to a performance deviation if the magnitude of the variance exceeds a threshold magnitude.

The performance deviation is compared to a threshold value that represents an acceptable tolerance for variance in performance of the well (510). In some implementations, a variance in performance may only correspond to a slight variance (e.g., 1% to 2% magnitude variance), whereas a performance deviation may correspond to a larger variance (e.g., 5% to 10% magnitude variance). For example, in one instance, the system 200 may be coded to employ conservative thresholds such that the system treats a performance deviation as being the same as a variance in performance, whereas in another instance a performance deviation is treated different from a variance in performance. In some implementations, the threshold value may be a value that is predetermined by a user, generated using a ML, model, or both. For example, the threshold value may be 200 to 300 pound per square inch (PSI).

Referencing step 506 of process 500, in some implementations, if the computed difference is less than a preset threshold there will be no action performed by the system 200. However, if the computed difference is greater than a preset threshold, then an automated response and action (e.g., warning, alarm, or physical response) is activated by the system 200 using the application. In some cases, the possibility of a remote shut-in of the well is determined and coded at certain prescribed thresholds that represent a particularly high magnitude of a performance deviation (or variance in performance of the well depending on the thresholds or magnitudes employed by the system 200).

A particular type of automated response is triggered when the performance deviation exceeds the predetermined threshold value (512). The automated response includes an action that addresses the variance in performance of the well. For example, the automated response can be an alert that triggers user intervention to bring detected pressures, temperatures, and flow rates into acceptable ranges. If the magnitude of the performance deviation is particularly high, then the automated response can trigger sending a command/control signal to cause physical response or autonomous vehicle intervention to bring detected pressures, temperatures, and flow rates into acceptable ranges (e.g., by slowing down production of the well). In some implementations, system 200 mitigates the need for downhole gauges at least by integrating the detection engine 205, with an example operations system for reservoir surveillance operations to initiate one or more actions autonomously such as shutting down a well in a controlled manner or changing production rates.

Figure 6:
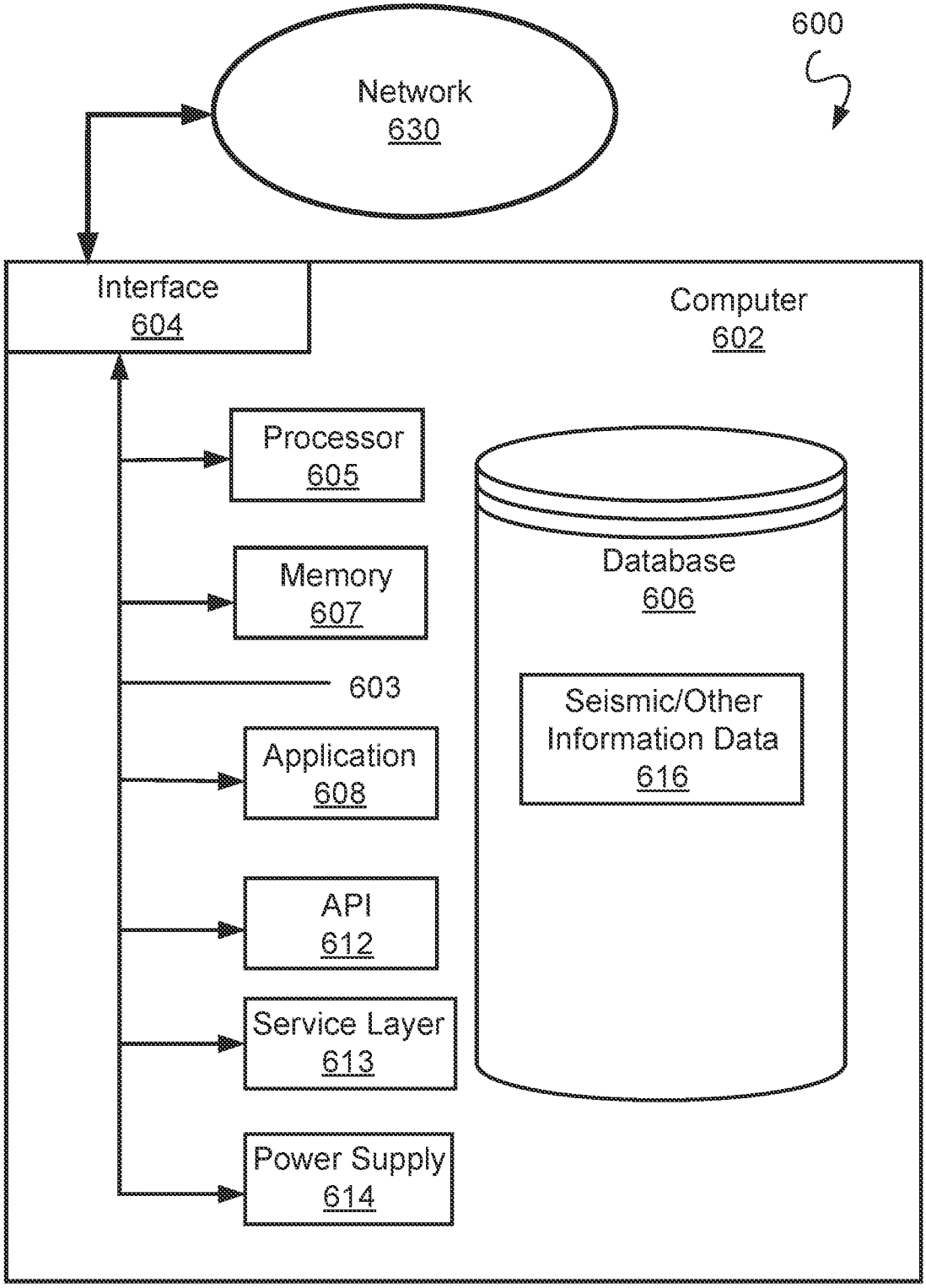
FIG. 6 is a block diagram illustrating an example computer system used to provide computational functionalities associated with described algorithms, methods, functions, processes, flows, and procedures according to some implementations.

FIG. 6 is a block diagram of an example computer system 600 used to provide computational functionalities associated with described algorithms, methods, functions, processes, flows, and procedures described in the present disclosure, according to some implementations of the present disclosure.

The illustrated computer 602 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 602 can include input devices such as keypads, keyboards, and touch screens that can accept user information. Also, the computer 602 can include output devices that can convey information associated with the operation of the computer 602. The information can include digital data, visual data, audio information, or a combination of information. The information can be presented in a graphical user interface (UI) (or GUI).

The computer 602 can serve in a role as a client, a network component, a server, a database, a persistency, or components of a computer system for performing the subject matter described in the present disclosure. The illustrated computer 602 is communicably coupled with a network 630. In some implementations, one or more components of the computer 602 can be configured to operate within different environments, including cloud-computing-based environments, local environments, global environments, and combinations of environments.

Generally, the computer 602 is an electronic computing device operable to receive, transmit, process, store, and manage data and information associated with the described subject matter. According to some implementations, the computer 602 can also include, or be communicably coupled with, an application server, an email server, a web server, a caching server, a streaming data server, or a combination of servers.

The computer 602 can receive requests over network 630 from a client application (for example, executing on another computer 602). The computer 602 can respond to the received requests by processing the received requests using software applications. Requests can also be sent to the computer 602 from internal users (for example, from a command console), external (or third) parties, automated applications, entities, individuals, systems, and computers.

Each of the components of the computer 602 can communicate using a system bus 603. In some implementations, any or all of the components of the computer 602, including hardware or software components, can interface with each other or the interface 604 (or a combination of both), over the system bus 603. Interfaces can use an application-programming interface (API) 612, a service layer 613, or a combination of the API 612 and service layer 613. The API 612 can include specifications for routines, data structures, and object classes. The API 612 can be either computer-language independent or dependent. The API 612 can refer to a complete interface, a single function, or a set of APIs.

The service layer 613 can provide software services to the computer 602 and other components (whether illustrated or not) that are communicably coupled to the computer 602. The functionality of the computer 602 can be accessible for all service consumers using this service layer. Software services, such as those provided by the service layer 613, can provide reusable, defined functionalities through a defined interface. For example, the interface can be software written in JAVA, C++, or a language providing data in extensible markup language (XML) format. While illustrated as an integrated component of the computer 602, in alternative implementations, the API 612 or the service layer 613 can be stand-alone components in relation to other components of the computer 602 and other components communicably coupled to the computer 602. Moreover, any or all parts of the API 612 or the service layer 613 can be implemented as child or sub-modules of another software module, enterprise application, or hardware module without departing from the scope of the present disclosure.

The computer 602 includes an interface 604. Although illustrated as a single interface 604 in FIG. 6, two or more interfaces 604 can be used according to particular needs, desires, or particular implementations of the computer 602 and the described functionality. The interface 604 can be used by the computer 602 for communicating with other systems that are connected to the network 630 (whether illustrated or not) in a distributed environment. Generally, the interface 604 can include, or be implemented using, logic encoded in software or hardware (or a combination of software and hardware) operable to communicate with the network 630. More specifically, the interface 604 can include software supporting one or more communication protocols associated with communications. As such, the network 630 or the interface's hardware can be operable to communicate physical signals within and outside of the illustrated computer 602.

The computer 602 includes a processor 605. Although illustrated as a single processor 605 in FIG. 6, two or more processors 605 can be used according to particular needs, desires, or particular implementations of the computer 602 and the described functionality. Generally, the processor 605 can execute instructions and can manipulate data to perform the operations of the computer 602, including operations using algorithms, methods, functions, processes, flows, and procedures as described in the present disclosure.

The computer 602 also includes a database 606 that can hold data, including seismic data 616 (for example, seismic data described earlier at least with reference to FIG. 1), for the computer 602 and other components connected to the network 630 (whether illustrated or not). For example, database 606 can be an in-memory, conventional, or a database storing data consistent with the present disclosure. In some implementations, database 606 can be a combination of two or more different database types (for example, hybrid in-memory and conventional databases) according to particular needs, desires, or particular implementations of the computer 602 and the described functionality. Although illustrated as a single database 606 in FIG. 6, two or more databases (of the same, different, or combination of types) can be used according to particular needs, desires, or particular implementations of the computer 602 and the described functionality. While database 606 is illustrated as an internal component of the computer 602, in alternative implementations, database 606 can be external to the computer 602.

The computer 602 also includes a memory 607 that can hold data for the computer 602 or a combination of components connected to the network 630 (whether illustrated or not). Memory 607 can store any data consistent with the present disclosure. In some implementations, memory 607 can be a combination of two or more different types of memory (for example, a combination of semiconductor and magnetic storage) according to particular needs, desires, or particular implementations of the computer 602 and the described functionality. Although illustrated as a single memory 607 in FIG. 6, two or more memories 607 (of the same, different, or combination of types) can be used according to particular needs, desires, or particular implementations of the computer 602 and the described functionality. While memory 607 is illustrated as an internal component of the computer 602, in alternative implementations, memory 607 can be external to the computer 602.

The application 608 can be an algorithmic software engine providing functionality according to particular needs, desires, or particular implementations of the computer 602 and the described functionality. For example, application 608 can serve as one or more components, modules, or applications. Further, although illustrated as a single application 608, the application 608 can be implemented as multiple applications 608 on the computer 602. In addition, although illustrated as internal to the computer 602, in alternative implementations, the application 608 can be external to the computer 602.

The computer 602 can also include a power supply 614. The power supply 614 can include a rechargeable or non-rechargeable battery that can be configured to be either user- or non-user-replaceable. In some implementations, the power supply 614 can include power-conversion and management circuits, including recharging, standby, and power management functionalities. In some implementations, the power-supply 614 can include a power plug to allow the computer 602 to be plugged into a wall socket or a power source to, for example, power the computer 602 or recharge a rechargeable battery.

There can be any number of computers 602 associated with, or external to, a computer system containing computer 602, with each computer 602 communicating over network 630. Further, the terms "client," "user," and other appropriate terminology can be used interchangeably, as appropriate, without departing from the scope of the present disclosure. Moreover, the present disclosure contemplates that many users can use one computer 602 and one user can use multiple computers 602.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus.

Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC).

In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example, LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment.

A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network.

While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks.

Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing.

Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

Particular embodiments of the subject matter have been described. Other embodiments are within the scope of the following claims. For example, the actions recited in the claims can be performed in a different order and still achieve desirable results. As one example, some processes depicted in the accompanying figures do not necessarily require the particular order shown, or sequential order, to achieve desirable results.

What is claimed is:

1. A computer-implemented method implemented using a system for managing operations involving a well in a subsurface region, the computer-implemented method comprising:

obtaining production data about the well comprising production rates, flowing wellhead pressure, and flowing wellhead temperature;

generating based on changes in flowing wellhead pressure over time, with each time step having an associated cumulative production a simulated average reservoir pressure at the subsurface region that comprises the well;

computing a difference between an average reservoir pressure obtained from the production data and the simulated average reservoir pressure;

determining, based on the difference, a performance deviation with reference to a particular area of the subsurface region that comprises the well;

comparing the performance deviation to a predetermined threshold value that represents an acceptable tolerance for variance in performance of the well indicative of an interference between the performance of the well and a neighboring well within the subsurface region;

determining that the performance deviation exceeds the predetermined threshold value; and triggering a particular type of automated response comprising an action that addresses the variance in the performance of the well by controlling downhole gauges to regulate pressures, temperatures, and flow rates within the well to correct the interference between the performance of the well and the neighboring well within the subsurface region.

2. The computer-implemented method of claim 1, wherein determining a performance deviation comprises:

determining a magnitude of the variance in performance of the well.

3. The computer-implemented method of claim 2, wherein triggering a particular type of automated response comprises:

selecting a particular type of automated response based at least on the magnitude of the variance in performance of the well; and triggering an action of the particular type of automated response that reduces the magnitude of the variance in performance of the well.

4. The computer-implemented method of claim 3, wherein triggering an action of the particular type of automated response comprises:

triggering an action that eliminates the variance in performance of the well and the performance deviation.

5. The computer-implemented method of claim 4, wherein the particular type of automated response comprises at least one of:

an action that generates a warning notification; or an action that generates an alarm signal.

6. The computer-implemented method of claim 1, wherein:

the well is a gas or hydrocarbon producing well; and the simulated average reservoir pressure is based on predictions about a plurality of values for flow rate, pressure, and temperature relating to the gas or hydrocarbon producing well.

7. The computer-implemented method of claim 6, wherein the performance deviation comprises flow conditions of the well that are outside the acceptable tolerance for variance in performance of the well.

8. The computer-implemented method of claim 7, wherein the particular type of automated response comprises at least one of:

an action that causes, by an autonomous system, intervention at the particular area of the subsurface region that includescomprises the well; or a total shut-in of the gas producing well.

9. The computer-implemented method of claim 1, wherein the interference comprises an intrusion of fluids from the well to the neighboring well in the subsurface region.

10. A system for managing a well in a subsurface region, the system comprising:

one or more processors configured to perform operations comprising:

obtaining production data about the well comprising production rates, flowing wellhead pressure, and flowing wellhead temperature;

generating based on changes in flowing wellhead pressure over time, with each time step having an associated cumulative production a simulated average reservoir pressure at the subsurface region that comprises the well;

computing a difference between an average reservoir pressure obtained from the production data and the simulated average reservoir pressure;

determining, based on the difference, a performance deviation with reference to a particular area of the subsurface region that comprises the well;

comparing the performance deviation to a predetermined threshold value that represents an acceptable tolerance for variance in performance of the well indicative of an interference between the performance of the well and a neighboring well within the subsurface region; and triggering, when the performance deviation exceeds the predetermined threshold value, a particular type of automated response comprising an action that addresses the variance in performance of the well by controlling downhole gauges to regulate pressures, temperatures, and flow rates within the well to correct the interference between the performance of the well and the neighboring well within the subsurface region.

11. The system of claim 10, wherein determining a performance deviation comprises:

determining a magnitude of the variance in performance of the well.

12. The system of claim 11, wherein triggering a particular type of automated response comprises:

selecting a particular type of automated response based at least on the magnitude of the variance in performance of the well; and triggering an action of the particular type of automated response that reduces the magnitude of the variance in performance of the well.

13. The system of claim 12, wherein triggering an action of the particular type of automated response comprises:

triggering an action that eliminates the variance in performance of the well and the performance deviation.

14. The system of claim 13, wherein the particular type of automated response comprises at least one of:

an action that generates a warning notification; or an action that generates an alarm signal.

15. The system of claim 10, wherein:

the well is a gas or hydrocarbon producing well; and the simulated average reservoir pressure is based on predictions about a plurality of values for flow rate, pressure, and temperature relating to the gas or hydrocarbon producing well.

16. The system of claim 15, wherein the performance deviation comprises flow conditions of the well that are outside the acceptable tolerance for variance in performance of the well.

17. The system of claim 16, wherein the particular type of automated response comprises at least one of:

an action that causes, by an autonomous system, intervention at the particular area of the subsurface region that comprises the well; or a total shut-in of the gas producing well.

18. The system of claim 10, wherein the interference comprises an intrusion of fluids from the well to the neighboring well in the subsurface region.

19. A non-transitory computer storage medium encoded with instructions that, when executed by one or more computers, cause the one or more computers to perform operations for managing a well in a subsurface region, the operations comprising:

obtaining production data about the well comprising production rates, flowing wellhead pressure, and flowing wellhead temperature;

generating based on changes in flowing wellhead pressure over time, with each time step having an associated cumulative production a simulated average reservoir pressure at the subsurface region that comprises the well;

computing a difference between an average reservoir pressure obtained from the production data and the simulated average reservoir pressure;

determining, based on the difference, a performance deviation with reference to a particular area of the subsurface region that comprises the well;

comparing the performance deviation to a predetermined threshold value that represents an acceptable tolerance for variance in performance of the well indicative of an interference between the performance of the well and a neighboring well within the subsurface region; and triggering, when the performance deviation exceeds the predetermined threshold value, a particular type of automated response comprising an action that addresses the variance in performance of the well by controlling downhole gauges to regulate pressures, temperatures, and flow rates within the well to correct the interference between the performance of the well and the neighboring well within the subsurface region.

20. The non-transitory computer storage medium of claim 19, wherein determining a performance deviation comprises:

determining a magnitude of the variance in performance of the well.

* * * * *